United States Patent [19]

Ishigami et al.

[11] 4,360,934

[45] Nov. 30, 1982

[54] SANITARY DEVICE

[75] Inventors: Noriakira Ishigami, Anjo; Takahisa Hasebe, Toyoake; Takeyoshi Kaminishizono, Toyota, all of Japan

[73] Assignee: Aisin Seiki Kabushiki Kaisha, Kariya, Japan

[21] Appl. No.: 254,327

[22] Filed: Apr. 14, 1981

[30] Foreign Application Priority Data

Apr. 21, 1980 [JP] Japan ..... 55-052628

[51] Int. Cl.[3] ..... E03D 9/08; A47K 4/00; A47K 3/02

[52] U.S. Cl. ..... 4/420.2; 4/420.1; 4/420.4; 4/443

[58] Field of Search ..... 4/447, 448, 420.2, 420.4, 4/420.1, 443, 420.5

[56] References Cited

U.S. PATENT DOCUMENTS

| | | | |
|---|---|---|---|
| 2,826,761 | 3/1958 | Lazarus et al. | 4/448 X |
| 3,247,524 | 4/1966 | Umann | 4/420.2 |
| 3,462,766 | 8/1969 | Merkel, Jr. | 4/420.2 |
| 3,594,826 | 7/1971 | Maurer | 4/420.2 |
| 3,947,899 | 4/1972 | Robinson et al. | 4/420.2 X |
| 4,123,807 | 11/1978 | Oguma et al. | 4/420.2 X |
| 4,192,023 | 3/1980 | McComb | 4/448 |
| 4,237,560 | 12/1980 | Riegeman et al. | 4/420.2 X |
| 4,304,016 | 12/1981 | Oguma et al. | 4/420.2 |

*Primary Examiner*—Henry K. Artis

*Attorney, Agent, or Firm*—Sughrue, Mion, Zinn, Macpeak & Seas

[57] ABSTRACT

A sanitary device of the type associated with a toilet bowl and having an extendable and retractable spray arm is provided with a hot water supply tank having a heating element therein. The pressure of the cold water supply forces the heated water through the spray nozzle and a partition is provided within the tank between the cold water inlet and the hot water outlet to prevent cold from being inadvertently forced through the hot water outlet.

4 Claims, 3 Drawing Figures

SANITARY DEVICE

BACKGROUND OF THE INVENTION

The present invention is directed to a sanitary device and more particularly to the hot water supply arrangement for a spray-type sanitary device associated with a toilet bowl for automatically cleansing and drying the anus of the human body while the user is in the usual sitting position on the toilet bowl.

Conventionally, in sanitary devices of this general character, cold water is supplied under pressure to a supply tank having heating means therein and the increased pressure within the supply tank will force hot water from the supply tank through a retractable arm having a spray nozzle at one end thereof.

Due to the size of the supply tank, the cold water inlet and the hot water outlet are fairly close to each other, and due to the presence of various obstacles within the tank such as the housing for the retractable spray arm, the cold water is often deflected into the vicinity of the outlet for the hot water so that cold water is often delivered to the spray nozzle without being properly heated. Needless to say, the sudden application of cold water when hot water is expected is most undesirable.

A sanitary device of the type described above is disclosed in U.S. Pat. No. 4,123,807. In this patent, the cold water is supplied under pressure through an inlet 13 and hot water is withdrawn from the tank through an outlet 14. The housing 21 for the retractable spray arm 27 substantially bisects the tank with the end thereof which is in communication with the hot water being disposed higher than the end from which the arm 27 is extendable and retractable. The water heating coil 4 is located adjacent the bottom of the tank below the housing for the retractable spray arm and it is necessary for the incoming cold water to be heated by the coil prior to being discharged. While the pressure of the incoming water generally directs cold water towards the bottom of the tank where it can come into contact with the heating coil, a substantial portion of the incoming cold water may be deflected from the cylindrical housing 21 for the retractable spray arm into the vicinity of the hot water outlet without being properly heated. Therefore, such cold water can frequently be inadvertently discharged through the outlet 14, much to the surprise of the user.

SUMMARY OF THE INVENTION

The sanitary device according to the present invention provides a new and improved hot water supply which substantially overcomes all of the aforementioned drawbacks of conventional sanitary devices.

The sanitary device according to the present invention provides a hot water supply tank having a partition extending downwardly from the top wall of the tank intermediate the cold water inlet and hot water outlet with the sides of the partition disposed in contact with two sidewalls of the tank so that all of the incoming cold water will be directed downwardly beneath the partition and pass a heating coil before the water can be discharged from the outlet at the proper elevated temperature. The partition may extend lengthwise of and in contact with the cylindrical housing for the retractable spray arm so that all of the incoming cold water must pass beneath the cylindrical housing. Alternatively, the partition may extend transversely across the longitudinal axis of the cylindrical housing in closely spaced relation to the bottom of the tank with a suitable recess being provided complementary to the cylindrical housing for the passage of the cylindrical housing through the partition. In either case, the extended flow path for the cold water will insure the passage of the water over the heating coil before reaching the outlet, thereby guaranteeing the continuous even supply of hot water to the spray nozzle.

The foregoing and other objects, features and advantages of the invention will be apparent from the following more particular description of preferred embodiments of the invention as illustrated in the accompanying drawings.

DETAILED DESCRIPTION OF THE PREFERRED EMBODIMENTS

Figure 1:
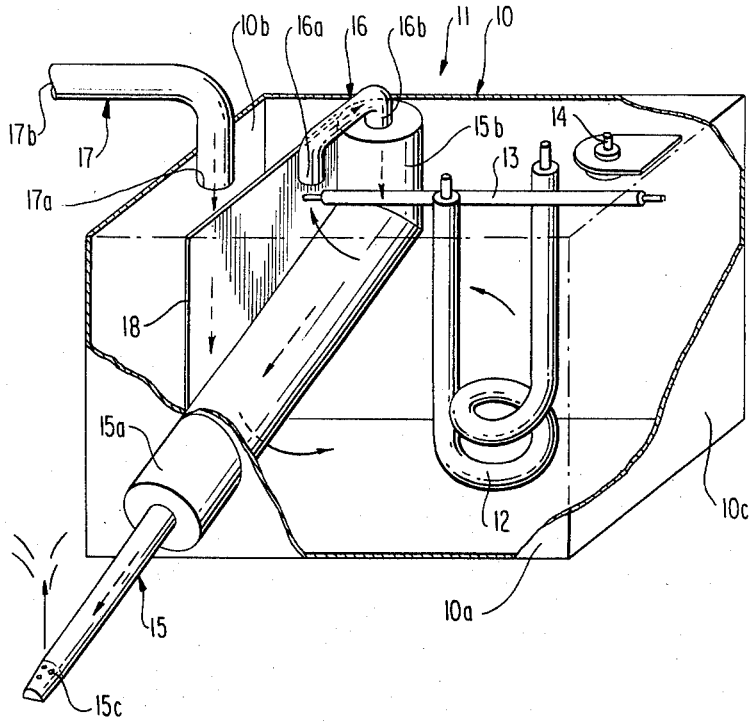
FIG. 1 is a perspective view of the first embodiment of the sanitary device according to the present invention.
Figure 2:
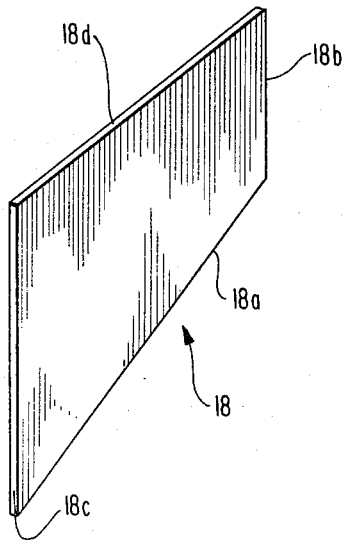
FIG. 2 is a perspective view of the partition utilizing the embodiment of FIG. 1.

In the embodiment shown in FIGS. 1 and 2, a sanitary device 11 includes a hot water tank 10 in which the hot water is kept at a predetermined temperature by means of a heating coil 12 and a thermostat 13 under control of suitable regulating means. An auxiliary thermostat 14 is provided as a back up in case of trouble with the main thermostat 13.

An extendable and retractable nozzle 15 having a spray outlet 15*c* at one end thereof is slideably mounted within a cylindrical housing 15*a* located within the tank 10. The cylindrical housing 15*a* passes in a fluid tight manner through the front wall 10*a* of the tank 10 and is inclined within the tank so that the end thereof connected to the inlet portion 15*b* is higher than the end thereof passing through the wall 10. The upper end of the inlet portion 15*b* is in engagement with the upper wall 10*b* of the tank 10 and may be selectively communicable with atmospheric pressure by any suitable means (not shown).

A substantially inverted U-shaped pipe 16 is provided for supplying hot water from the tank 10 to the inlet portion 15*b* of the nozzle 15. One end 16*a* of the pipe 16 extends through the upper wall 10*b* of the tank 10 in communication with the interior thereof and the portion 16*b* of the pipe 16 passes through the upper wall 10*b* of the tank 10 into communication with the inlet portion 15*b* of the nozzle 15. A source of cold water is connected to the end 17*b* of the inlet pipe 17 with the other end 17*a* extending through the upper wall of a tank into communication with the interior thereof. The detailed construction and operation of the sanitary device described thus far is similar to that disclosed in U.S. Pat. No. 4,123,807 and a further detailed explanation is not deemed necessary.

In the embodiment shown in FIGS. 1 and 2, a partition 18 is provided in the tank 10 so that cold water supplied thereto can not be directly supplied to the inlet portion 16*a* of the pipe 16. The partition 18 shown in FIGS. 1 and 2 is disclosed in engagement with the cylindrical housing 15*a* and the inlet 15*b* with the sides 18*a*,

18*b*, 18*c* and 18*d* being disposed in abutment with the cylindrical housing, the rear wall 10*c* of the tank, the front wall 10*a* of the tank, and the upper wall 10*b* of the tank, respectively. Accordingly, cold water supplied to the tank 10 through the pipe 17 will pass downwardly on one side of the partition 18, pass under the cylindrical housing 15*a* and then move upwardly over the heating coil 12 so that the water will be warmed to a predetermined temperature before leaving through the outlet pipe 16 to the spray nozzle. Thus, there is no danger of cold water being ejected from the nozzle 15.

Figure 3:
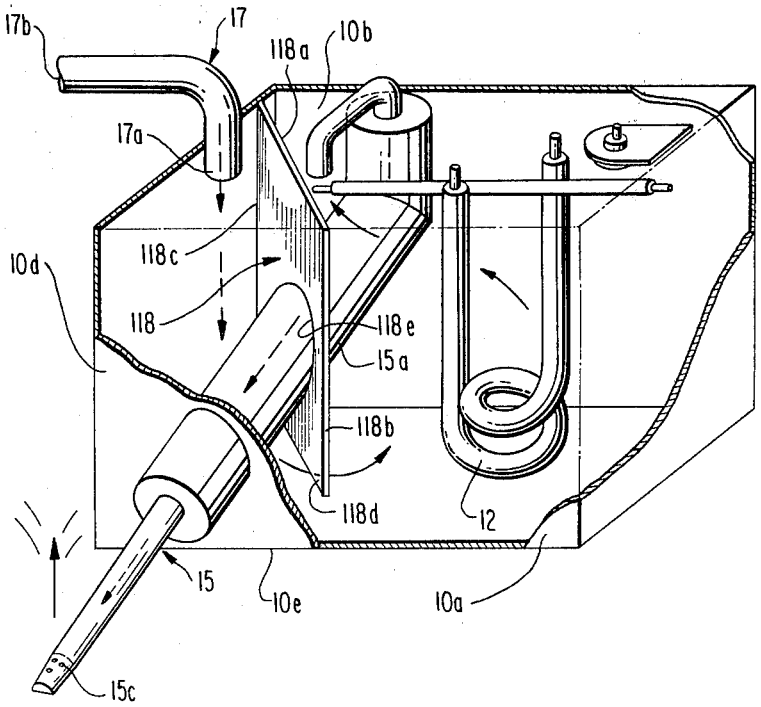
FIG. 3 is a perspective view of a second embodiment of the sanitary device according to the present invention.

A second embodiment of the sanitary device is shown in FIG. 3, wherein the partition 118 extends transversely relative to the axis of the cylindrical housing 15*a*. The partition 118 is substantially rectangular in form, with the upper edge 118*a* abutting the top wall 10*b* of the tank, the edge 118*b* abutting the front wall 10*a* of the tank and the edge 118*c* disposed in abutment with the wall 10*d* of the tank. The lower edge 118*d* of the partition is formed with a recess 118*e* complementary to the external circumference of the cylindrical housing 15*a* and the lower edge 118*d* is spaced from the bottom wall 10*e* of the tank to allow the passage of cold water entering through the pipe 17 from one side of the partition 118 to the other side of the partition where it will contact the heating coil 12 so as to be warmed to the proper temperature before exiting through the outlet pipe.

While the invention has been particularly shown and described with reference to preferred embodiments thereof, it will be understood by those in the art that the foregoing and other changes in form and detail may be made therein without departing from the spirit and scope of the invention.

What is claimed is:

1. A sanitary device comprising:

tank means for holding a supply of hot water, nozzle means having inlet means at one end thereof adjacent one side of said tank and outlet means at the opposite end thereof adjacent the bottom of said tank an an opposite side thereof with said outlet means adapted to be positioned in a toilet bowl, an inlet opening in the top of said tank adapted to be connected to a source of cold water under pressure, an outlet opening in the top of said tank, pipe means connecting said outlet opening to said inlet means for said nozzle means, partition means disposed in said tank and extending downwardly from the top wall of said tank intermediate said inlet opening and said outlet opening into engagement with said nozzle means with opposite side edges of said partition disposed in engagement with two sidewalls of said tank and heating means located in said tank on the same side of said partition as said outlet opening.

2. A sanitary device as set forth in claim 1, wherein said nozzle includes an elongated cylindrical housing inclined downwardly in said tank from said one side thereof to said opposite side.

3. A sanitary device as set forth in claim 2, wherein said partition means has a planar configuration and extends parallel to the axis of said cylindrical housing with the lower edge thereof disposed in engagement with said cylindrical housing.

4. A sanitary device as set forth in claim 2, wherein said partition has a planar configuration extending transversely to the axis of said cylindrical housing with the lower edge thereof disposed below said cylindrical housing with recess means extending upwardly from said lower edge to accommodate passage of said cylindrical housing therethrough.

* * * * *